US008941331B2

(12) United States Patent
Roberts et al.

(10) Patent No.: US 8,941,331 B2
(45) Date of Patent: Jan. 27, 2015

(54) SOLID STATE LIGHTING PANELS WITH VARIABLE VOLTAGE BOOST CURRENT SOURCES

(71) Applicant: Cree, Inc., Durham, NC (US)

(72) Inventors: John K. Roberts, Grand Rapids, MI (US); Keith J. Vadas, Lake Worth, FL (US); Muhinthan Murugesu, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/896,977

(22) Filed: May 17, 2013

(65) Prior Publication Data

US 2013/0249408 A1 Sep. 26, 2013

Related U.S. Application Data

(63) Continuation of application No. 13/469,188, filed on May 11, 2012, now Pat. No. 8,461,776, which is a continuation of application No. 12/977,422, filed on Dec. 23, 2010, now Pat. No. 8,203,286, which is a (Continued)

(51) Int. Cl.

| | |
|---|---|
| ***G05F 1/00*** | (2006.01) |
| ***H05B 33/08*** | (2006.01) |
| ***G09G 3/34*** | (2006.01) |

(52) U.S. Cl.

CPC ..... *H05B 33/0809* (2013.01); *H05B 33/0863* (2013.01); *G09G 2320/0653* (2013.01);

(Continued)

(58) Field of Classification Search

USPC ..... 315/291, 307, 224, 246, 185 R, 200 R, 315/312, 308

See application file for complete search history.

(56) References Cited

U.S. PATENT DOCUMENTS

| | | | |
|---|---|---|---|
| 3,787,752 | A | 1/1974 | Delay |
| 4,298,869 | A | 11/1981 | Okuno |

(Continued)

FOREIGN PATENT DOCUMENTS

| | | |
|---|---|---|
| EP | 1 033 903 | 9/2000 |
| GB | 2 249 840 | 5/1992 |

(Continued)

OTHER PUBLICATIONS

U.S. Appl. No. 11/854,744, filed Sep. 13, 2007, Myers.

(Continued)

*Primary Examiner* — Minh D A

(74) *Attorney, Agent, or Firm* — Myers Bigel Sibley & Sajovec, P.A.

(57) ABSTRACT

A lighting system includes a lighting panel having a string of solid state lighting devices and a current supply circuit having a voltage input terminal, a control input terminal, and first and second output terminals coupled to the string of solid state lighting devices. The current supply circuit is configured to supply an on-state drive current to the string of solid state lighting devices in response to a control signal. The current supply circuit includes a charging inductor coupled to the voltage input terminal and an output capacitor coupled to the first output terminal. The current supply circuit is configured to operate in continuous conduction mode in which current continuously flows through the charging inductor while the on-state drive current is supplied to the string of solid state light emitting devices.

25 Claims, 6 Drawing Sheets

Related U.S. Application Data continuation of application No. 11/601,504, filed on Nov. 17, 2006, now Pat. No. 7,872,430.

(60) Provisional application No. 60/738,305, filed on Nov. 18, 2005.

(52) U.S. Cl.

CPC ..... *G09G3/3406* (2013.01); *H05B 33/0872* (2013.01); *H05B 33/0821* (2013.01); *G09G 2360/145* (2013.01); *H05B 33/0869* (2013.01); *G09G 2320/064* (2013.01); *H05B 33/0803* (2013.01); *G09G 3/3413* (2013.01)

USPC ..... 315/308

(56) References Cited

U.S. PATENT DOCUMENTS 4,685,303 A 8/1987 Branc et al.
4,859,911 A 8/1989 Kinnard et al.
4,988,889 A 1/1991 Oughton, Jr.
5,128,595 A 7/1992 Hara
5,661,645 A 8/1997 Hochstein
5,783,909 A 7/1998 Hochstein
5,812,105 A 9/1998 Van de Ven
5,877,595 A 3/1999 Nerone ..... 315/209 R
5,949,222 A 9/1999 Buono
5,973,483 A 10/1999 Jo
6,016,038 A 1/2000 Mueller et al.
6,018,220 A 1/2000 Nerone
6,051,935 A 4/2000 Bucks et al.
6,076,936 A 6/2000 George
6,082,870 A 7/2000 George
6,150,771 A 11/2000 Perry
6,150,774 A 11/2000 Mueller et al.
6,153,985 A 11/2000 Grossman
6,161,910 A 12/2000 Reisenauer et al.
6,181,079 B1 1/2001 Chang et al.
6,236,331 B1 5/2001 Dussureault
6,255,786 B1 * 7/2001 Yen ..... 315/291
6,285,139 B1 9/2001 Ghanem
6,329,758 B1 12/2001 Salam
6,329,760 B1 12/2001 Bebenroth
6,329,764 B1 12/2001 Van de Ven
6,351,079 B1 2/2002 Willis
6,359,392 B1 3/2002 He
6,362,578 B1 3/2002 Swanson et al.
6,388,393 B1 5/2002 Illingworth
6,411,046 B1 6/2002 Muthu
6,416,200 B1 7/2002 George
6,441,558 B1 8/2002 Muthu et al. ..... 315/149
6,471,716 B1 * 10/2002 Pecukonis ..... 607/89
6,495,964 B1 12/2002 Muthu et al.
6,507,159 B2 1/2003 Muthu
6,510,955 B2 1/2003 Pellegrino
6,510,995 B2 1/2003 Muthu et al. ..... 235/454
6,515,434 B1 2/2003 Biebl
6,552,495 B1 4/2003 Chang
6,577,072 B2 6/2003 Saito et al.
6,577,512 B2 6/2003 Tripathi et al.
6,578,986 B2 6/2003 Swaris et al.
6,586,890 B2 7/2003 Min et al.
6,616,291 B1 9/2003 Love
6,618,031 B1 9/2003 Bohn, Jr. et al.
6,621,235 B2 9/2003 Chang ..... 315/216
6,630,801 B2 10/2003 Schuurmans
6,712,486 B1 3/2004 Popovich et al.
6,717,559 B2 * 4/2004 Weindorf ..... 345/82
6,788,011 B2 9/2004 Mueller et al.
6,793,374 B2 9/2004 Begemann
6,806,659 B1 10/2004 Mueller et al.
6,836,081 B2 12/2004 Swanson et al.
6,846,093 B2 1/2005 Swaris et al.
6,858,994 B2 2/2005 Vollrath
6,864,641 B2 3/2005 Dygert
6,870,328 B2 3/2005 Tanabe et al. ..... 315/291
6,888,529 B2 * 5/2005 Bruning et al. ..... 345/102
6,894,436 B2 5/2005 Togashi et al.
6,909,249 B2 6/2005 Otake
6,940,189 B2 9/2005 Gizara ..... 307/151
6,965,205 B2 11/2005 Piepgras et al.
6,975,079 B2 12/2005 Lys et al.
7,014,336 B1 3/2006 Ducharme et al.
7,015,654 B1 3/2006 Kuhlmann et al.
7,038,399 B2 5/2006 Lys et al.
7,088,334 B2 8/2006 Adachi et al.
7,102,172 B2 9/2006 Lynch et al.
7,108,396 B2 9/2006 Swaris et al.
7,114,831 B2 10/2006 Popovich et al.
7,122,971 B2 10/2006 Yeh et al.
7,148,632 B2 12/2006 Berman et al.
7,180,252 B2 2/2007 Lys et al.
7,202,608 B2 4/2007 Robinson et al.
7,213,940 B1 5/2007 Van De Ven et al.
7,236,148 B2 6/2007 Yoshida et al.
7,239,087 B2 7/2007 Ball
7,255,457 B2 8/2007 Ducharme et al.
7,274,160 B2 9/2007 Mueller et al.
7,276,861 B1 10/2007 Shteynberg et al.
7,301,288 B2 11/2007 Green
7,306,353 B2 12/2007 Popovich et al.
7,317,287 B2 1/2008 Blumel
7,323,828 B2 1/2008 Russell et al.
7,329,024 B2 2/2008 Lynch et al.
7,387,406 B2 6/2008 Swaris et al.
7,474,044 B2 1/2009 Ge
7,557,524 B2 7/2009 Chevalier et al.
7,569,996 B2 8/2009 Holmes et al.
7,872,430 B2 * 1/2011 Roberts et al. ..... 315/307
8,203,266 B2 * 6/2012 Egawa et al. ..... 313/544
8,203,286 B2 6/2012 Roberts et al. ..... 315/307
8,461,776 B2 * 6/2013 Roberts et al. ..... 315/291
2001/0024112 A1 9/2001 Jacobs et al.
2003/0011559 A1 1/2003 Adachi et al.
2003/0137475 A1 7/2003 Yoshida et al.
2004/0046510 A1 3/2004 Allen
2004/0135522 A1 7/2004 Berman et al.
2004/0135524 A1 * 7/2004 Gunter et al. ..... 315/291
2005/0077838 A1 4/2005 Blumel
2005/0093473 A1 5/2005 Yeh et al.
2005/0207196 A1 9/2005 Holmes et al.
2005/0243556 A1 11/2005 Lynch
2005/0251698 A1 11/2005 Lynch et al.
2006/0001381 A1 1/2006 Robinson et al.
2006/0267028 A1 11/2006 Lynch et al.
2007/0041220 A1 2/2007 Lynch
2007/0115248 A1 5/2007 Roberts et al.
2007/0137074 A1 6/2007 Van De Ven et al.
2007/0139920 A1 6/2007 Van De Ven et al.
2007/0139923 A1 6/2007 Negley et al.
2007/0170447 A1 7/2007 Negley et al.
2007/0171145 A1 7/2007 Coleman et al.
2007/0211463 A1 9/2007 Chevalier et al.
2007/0236911 A1 10/2007 Negley
2007/0263393 A1 11/2007 Van De Ven
2007/0267983 A1 11/2007 Van De Ven et al.
2007/0274063 A1 11/2007 Negley
2007/0274080 A1 11/2007 Negley et al.
2007/0278503 A1 12/2007 Van De Ven et al.
2007/0278934 A1 12/2007 Van De Ven et al.
2007/0279440 A1 12/2007 Negley
2007/0279903 A1 12/2007 Negley et al.
2007/0280624 A1 12/2007 Negley et al.
2008/0048582 A1 2/2008 Robinson
2008/0055915 A1 3/2008 Lynch et al.
2008/0062699 A1 3/2008 Popovich et al.
2008/0084685 A1 4/2008 Van De Ven et al.
2008/0084700 A1 4/2008 Van De Ven
2008/0084701 A1 4/2008 Van De Ven et al.
2008/0088248 A1 4/2008 Myers
2008/0089053 A1 4/2008 Negley
2008/0106895 A1 5/2008 Van De Ven et al.
2008/0106907 A1 5/2008 Trott et al.
2008/0112168 A1 5/2008 Pickard et al.
2008/0112170 A1 5/2008 Trott et al.

(56) References Cited

U.S. PATENT DOCUMENTS

| | | | |
|---|---|---|---|
| 2008/0130285 | A1 | 6/2008 | Negley et al. |
| 2008/0136313 | A1 | 6/2008 | Van De Ven et al. |
| 2008/0192462 | A1 | 8/2008 | Steedly et al. |
| 2008/0259589 | A1 | 10/2008 | Van De Ven |
| 2008/0278097 | A1 | 11/2008 | Roberts et al. |
| 2009/0184666 | A1 | 7/2009 | Myers et al. |

FOREIGN PATENT DOCUMENTS

| | | |
|---|---|---|
| JP | 10-233669 | 9/1998 |
| JP | 2001-215913 | 8/2001 |
| JP | 2002-203988 | 7/2002 |
| JP | 2003-513602 | 4/2003 |
| JP | 2003-518714 | 6/2003 |
| JP | 2004-538653 | 12/2004 |
| JP | 2006-242733 | 9/2006 |
| JP | 2006-525664 | 9/2006 |
| TW | 200501039 | 1/2005 |
| WO | WO 01/33917 | 5/2001 |
| WO | WO 2004/060023 | 7/2004 |
| WO | WO 2004/100612 | 11/2004 |

OTHER PUBLICATIONS

U.S. Appl. No. 11/755,162, filed May 30, 2007, Negley.

U.S. Appl. No. 11/626,483, filed Jan. 24, 2007, Coleman.

DiLouie, "HID Lamp Dimming: Dimming HID lamps can produce significant energy savings and increase user flexibility", 6 pages http://www.ecmweb.com/mag/electric_hid_lamp_dimming/index.html, (Oct. 1, 2004).

In-Plug® Series: IPS401,"High Efficiency, High Power Factor, Universal High Brightness White LED Controller", ASIC Advantage, Inc., Rev.11, 18 pages, (Apr. 2, 2007).

Perduijn et al., "Light Output Feedback Solution for RGB LED Backlight Applications", SID Digest (2000).

OPTOLED Lighting Gmbh/LED, Product Sheets, http://www.optoled.de/englisch/products/led.html, pp. 1-7, Last Download: Jan. 16, 2009.

Permlight, LED Fixtures: Enbryten Retrofit to Replace Problematic Incandescence, 1 page (Feb. 2005).

International Search Report and Written Opinion (18 pages) corresponding to International Application No. PCT/US07/12708; Mailing Date: Feb. 20, 2008.

International Search Report and Written Opinion (11 pages) corresponding to International Application No. PCT/US07/01834; Mailing Date: Apr. 28, 2008.

Invitation to Pay Additional Fees (7 pages) corresponding to International Application No. PCT/US2007/078368; Mailing Date: Feb. 5, 2008.

International Search Report and Written Opinion (13 pages) corresponding to International Application No. PCT/US2007/078368; Mailing Date: Jul. 4, 2008.

Second PCT Written Opinion (6 pages) corresponding to International Application No. PCT/US07/01834; Mailing Date: Oct. 20, 2008.

U.S. Appl. No. 61/039,926, filed Mar. 27, 2008.

Japanese Office Action (English Translation) Corresponding to Japanese Patent Application No. 2008-541357; Date of Mailing: Jun. 17, 2011; 2 pages.

Taiwanese Office Action corresponding to Taiwanese Patent Application No. 095142943; Issuance Date: Jan. 28, 2013; Foreign Test, 5 pages, English Translation Thereof, 4 pages.

European Office Action corresponding to European Application No. 06 837 857.9, dated Nov. 5, 2012; 5 pages.

* cited by examiner

SOLID STATE LIGHTING PANELS WITH VARIABLE VOLTAGE BOOST CURRENT SOURCES

CROSS-REFERENCE TO RELATED APPLICATIONS

This application is a continuation of U.S. application Ser. No. 13/469,188, filed May 11, 2012, entitled "SOLID STATE LIGHTING PANELS WITH VARIABLE BOOST CURRENT SOURCES" which is a continuation of U.S. application Ser. No. 12/977,422, filed Dec. 23, 2010, entitled "SOLID STATE LIGHTING PANELS WITH VARIABLE VOLTAGE BOOST CURRENT SOURCES" which is a continuation of U.S. application Ser. No. 11/601,504, filed Nov. 17, 2006, entitled "SOLID STATE LIGHTING PANELS WITH VARIABLE VOLTAGE BOOST CURRENT SOURCES" which claims priority to U.S. Provisional Patent Application No. 60/738,305 entitled "SYSTEM AND METHOD FOR INTERCONNECTION AND INTEGRATION OF LED BACKLIGHTING MODULES" filed Nov. 18, 2005, the disclosures of which are hereby incorporated herein by reference as if set forth in its entirety.

FIELD OF THE INVENTION

The present invention relates to solid state lighting, and more particularly to adjustable solid state lighting panels and to systems and methods for generating high voltages for illuminating solid state lighting panels.

BACKGROUND

Solid state lighting arrays are used for a number of lighting applications. For example, solid state lighting panels including arrays of solid state lighting devices have been used as direct illumination sources, for example, in architectural and/or accent lighting. A solid state lighting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small liquid crystal display (LCD) display screens, such as LCD display screens used in portable electronic devices. In addition, there has been increased interest in the use of solid state lighting panels as backlights for larger displays, such as LCD television displays.

For smaller LCD screens, backlight assemblies typically employ white LED lighting devices that include a blue-emitting LED coated with a wavelength conversion phosphor that converts some of the blue light emitted by the LED into yellow light. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

The color rendering index of a light source is an objective measure of the ability of the light generated by the source to accurately illuminate a broad range of colors. The color rendering index ranges from essentially zero for monochromatic sources to nearly 100 for incandescent sources. Light generated from a phosphor-based solid state light source may have a relatively low color rendering index.

For large-scale illumination applications, it is often desirable to provide a lighting source that generates a white light having a high color rendering index, so that objects illuminated by the lighting panel may appear more natural. Similarly, for display backlight applications, it may be desirable to provide a backlight source that permits the display to have a large range of displayable colors (color gamut). Accordingly, such lighting sources may typically include an array of solid state lighting devices including red, green and blue light emitting devices. When red, green and blue light emitting devices are energized simultaneously, the resulting combined light may appear white, or nearly white, depending on the relative intensities of the red, green and blue sources, which may provide a high color rendering index. There are many different hues of light that may be considered "white." For example, some "white" light, such as light generated by sodium vapor lighting devices, may appear yellowish in color, while other "white" light, such as light generated by some fluorescent lighting devices, may appear more bluish in color. Similarly, a display may generate a large range of colors by altering the relative intensities of the red, green and blue light sources of a backlight unit.

For larger display and/or illumination applications, multiple solid state lighting tiles may be connected together, for example, in a two dimensional array, to form a larger lighting panel. Such lighting panels may generate a significant amount of heat, however, due to the large number of light emitting devices included therein and/or due to the operation of electronic driver circuitry included in the lighting panel. Heat generated by the lighting panel must be dissipated or else the lighting panel may overheat, potentially damaging the lighting panel and/or components thereof. In order to dissipate a large amount of heat, a lighting panel may be provided with heat sinks and/or other surfaces from which excess heat may be radiated. Such features may be undesirable for a lighting panel, however, since they may be bulky, heavy and/or expensive.

SUMMARY

A lighting system according to some embodiments of the invention includes a lighting panel having a string of solid state lighting devices and a current supply circuit having a voltage input terminal, a control input terminal, and first and second output terminals coupled to the string of solid state lighting devices. The current supply circuit may be configured to supply an on-state drive current to the string of solid state lighting devices in response to a control signal. The current supply circuit may include a charging inductor coupled to the voltage input terminal and an output capacitor coupled to the first output terminal. The current supply circuit may be configured to operate in continuous conduction mode in which a varying or constant current continuously flows through the charging inductor while the on-state drive current is supplied to the string of solid state light emitting devices.

The current supply circuit may include a rectifier having an anode coupled to the charging inductor and a cathode coupled to the storage capacitor, a controller having a control input and first and second control outputs, and a first control transistor coupled to the anode of the rectifier and having a control terminal coupled to the first control output of the controller. The first control transistor may be configured to cause the charging inductor to be energized in response to a first control signal from the controller and to cause energy stored in the charging inductor to be discharged through the rectifier and into the output capacitor in response to the first control signal.

The lighting system may further include a second control transistor coupled to the second output terminal of the current supply circuit and having an input coupled to the second control output of the controller. The second control transistor may be configured to cause a voltage stored in the output capacitor to be applied to the first output terminal of the current supply circuit in response to a second control signal from the controller.

The current supply circuit may further include a low pass filter between the second control output and the second control transistor.

The current supply circuit may further include a sense resistor coupled to the second output terminal of the current supply circuit, and the controller may further include a feedback input coupled to the sense resistor. The controller may be configured to activate the second control signal in response to a feedback signal received on the feedback input.

The current supply circuit may further include a low pass filter coupled between the sense resistor and the feedback input of the controller.

The charging inductor may have an inductance of about 50 μH to about 1.3 mH. In particular embodiments, the charging inductor may have an inductance of about 680 μH. The current supply circuit may be a variable voltage boost current supply circuit.

The lighting system may further include a plurality of strings of solid state light emitting devices and a plurality of current supply circuits connected to respective ones of the strings of solid state light emitting devices and configured to operate in continuous conduction mode.

The current supply circuit may be configured to convert at least about 85% of input power into output power. In some embodiments, the current supply circuit may be configured to convert at least about 90% of input power into output power.

Some embodiments of the invention provide methods of generating an on-state drive current for driving a string of solid state light emitting devices in a lighting system. The methods include energizing a charging inductor with an input voltage, discharging energy stored in the charging inductor into an output capacitor, and applying a voltage on the output capacitor to the string of solid state lighting devices, wherein current continuously flows through the charging inductor while the on-state drive current is supplied to the string of solid state light emitting devices.

Discharging energy stored in the charging inductor into an output capacitor may include discharging energy stored in the charging inductor through a rectifier. Energizing the charging inductor with an input voltage may include activating a first control transistor coupled to the charging inductor with a first control signal.

The methods may further include detecting an output current and activating the first control transistor in response to the detected output current. Applying a voltage on the output capacitor to the string of solid state lighting devices may include activating a second control transistor coupled to the string with a second control signal.

The methods may further include filtering the second control signal and applying the filtered second control signal to the second control transistor. The methods may further include filtering the detected output current using a low pass filter.

A lighting system according to some embodiments of the invention includes a lighting panel including a first string of solid state lighting devices configured to emit red light, a second string of solid state lighting devices configured to emit green light, and a third string of solid state lighting devices configured to emit blue light, and at least three current supply circuits coupled to the first, second and third strings, respectively. Each of the current supply circuits may include a variable voltage boost, constant current power supply circuit configured to operate in continuous current mode.

The lighting system may further include a digital control system coupled to the current supply circuits and configured to generate a plurality of pulse width modulation (PWM) control signals. Each of the current supply circuits is configured to supply an on-state drive current to the respective string of solid state lighting devices in response to one of the plurality of PWM control signals generated by the digital control system.

The digital control system may include a closed loop digital control system that is configured to generate the PWM control signals in response to sensor output signals generated by at least one light sensor in response to light output by the lighting panel.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS OF THE INVENTION

Figure 1:
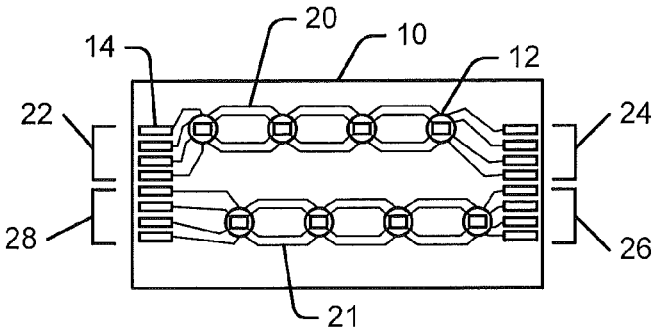
FIG. 1 is a front view of a solid state lighting tile in accordance with some embodiments of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention is described below with reference to flowchart illustrations and/or block diagrams of methods, systems and computer program products according to embodiments of the invention. It will be understood that some blocks of the flowchart illustrations and/or block diagrams, and combinations of some blocks in the flowchart illustrations and/or block diagrams, can be implemented by computer program instructions. These computer program instructions may be stored or implemented in a microcontroller, microprocessor, digital signal processor (DSP), field programmable gate array (FPGA), a state machine, programmable logic controller (PLC) or other processing circuit, general purpose computer, special purpose computer, or other programmable data processing apparatus such as to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Referring now to FIG. 1, a solid state lighting tile 10 may include thereon a number of solid state lighting elements 12 arranged in a regular and/or irregular two dimensional array. The tile 10 may include, for example, a printed circuit board (PCB) on which one or more circuit elements may be mounted. In particular, a tile 10 may include a metal core PCB (MCPCB) including a metal core having thereon a polymer coating on which patterned metal traces (not shown) may be formed. MCPCB material, and material similar thereto, is commercially available from, for example, The Bergquist Company. The PCB may further include heavy clad (4 oz. copper or more) and/or conventional FR-4 PCB material with thermal vias. MCPCB material may provide improved thermal performance compared to conventional PCB material. However, MCPCB material may also be heavier than conventional PCB material, which may not include a metal core.

In the embodiments illustrated in FIG. 1, the lighting elements 12 are multi-chip clusters of four solid state emitting devices per cluster. In the tile 10, four lighting elements 12 are serially arranged in a first path 20, while four lighting elements 12 are serially arranged in a second path 21. The lighting elements 12 of the first path 20 are connected, for example via printed circuits, to a set of four anode contacts 22 arranged at a first end of the tile 10, and a set of four cathode contacts 24 arranged at a second end of the tile 10. The lighting elements 12 of the second path 21 are connected to a set of four anode contacts 26 arranged at the second end of the tile 10, and a set of four cathode contacts 28 arranged at the first end of the tile 10.

Figure 2:
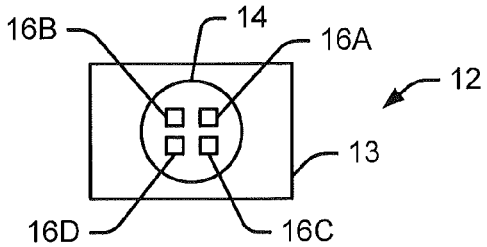
FIG. 2 is a top view of a packaged solid state lighting device including a plurality of LEDs in accordance with some embodiments of the invention.

The solid state lighting elements 12 may include, for example, organic and/or inorganic light emitting devices. An example of a solid state lighting element 12 for high power illumination applications is illustrated in FIG. 2. A solid state lighting element 12 may comprise a packaged discrete electronic component including a carrier substrate 13 on which a plurality of LED chips 16A-16D are mounted. In other embodiments, one or more solid state lighting elements 12 may comprise LED chips 16A-16D mounted directly onto electrical traces on the surface of the tile 10, forming a multi-chip module or chip on board assembly. Suitable tiles are disclosed in commonly assigned U.S. patent application Ser. No. 11/368,976 entitled "ADAPTIVE ADJUSTMENT OF LIGHT OUTPUT OF SOLID STATE LIGHTING PANELS" filed Mar. 6, 2006, the disclosure of which is incorporated herein by reference.

The LED chips 16A-16D may include at least a red LED 16A, a green LED 16B and a blue LED 16C. The blue and/or green LEDs may be InGaN-based blue and/or green LED chips available from Cree, Inc., the assignee of the present invention. The red LEDs may be, for example, AlInGaP LED chips available from Epistar, Osram Opto Semiconductors and others. The lighting element 12 may include an additional green LED 16D in order to make more green light available.

In some embodiments, the LEDs 16 may have a square or rectangular periphery with an edge length of about 900 μm or greater (i.e. so-called "power chips." However, in other embodiments, the LED chips 16 may have an edge length of 500 μm or less (i.e. so-called "small chips"). In particular, small LED chips may operate with better electrical conversion efficiency than power chips. For example, green LED chips with a maximum edge dimension less than 500 microns and as small as 260 μm, may commonly have a higher electrical conversion efficiency than 900 μm chips, and are known to typically produce 55 lumens of luminous flux per Watt of dissipated electrical power and as much as 90 lumens or more of luminous flux per Watt of dissipated electrical power.

As further illustrated in FIG. 2, the LEDs 16A-16D may be covered by an encapsulant 14, which may be clear and/or may include light scattering particles, phosphors, and/or other elements to achieve a desired emission pattern, color and/or intensity. While not illustrated in FIG. 2, the lighting device 12 may further include a reflector cup surrounding the LEDs 16A-16D, a lens mounted above the LEDs 16A-16D, one or more heat sinks for removing heat from the lighting device, an electrostatic discharge protection chip, and/or other elements.

Figure 3:
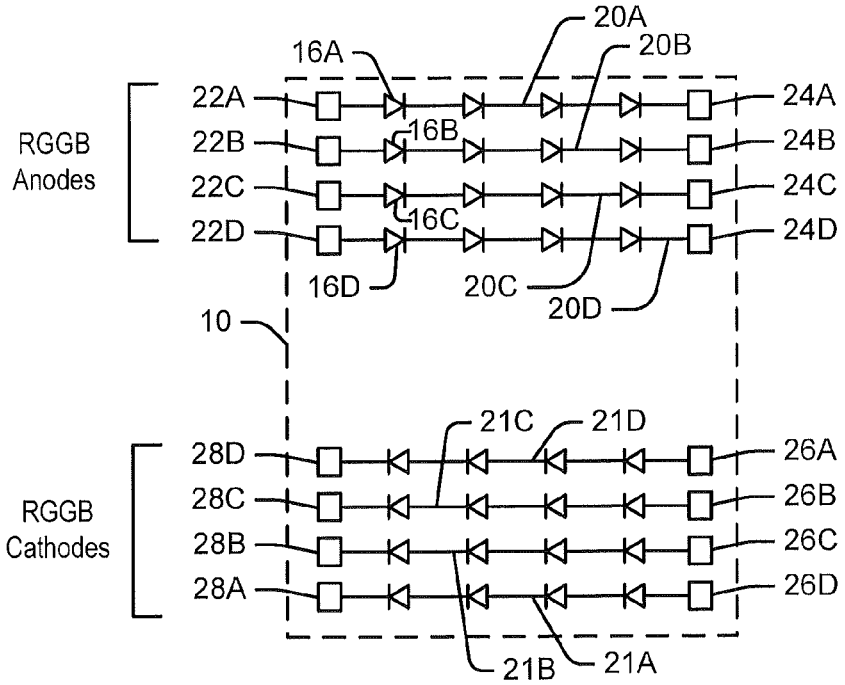
FIG. 3 is a schematic circuit diagram illustrating the electrical interconnection of LEDs in a solid state lighting tile in accordance with some embodiments of the invention.

LED chips 16A-16D of the lighting elements 12 in the tile 10 may be electrically interconnected as shown in the schematic circuit diagram in FIG. 3. As shown therein, the LEDs may be interconnected such that the blue LEDs 16A in the first path 20 are connected in series to form a string 20A. Likewise, the first green LEDs 16B in the first path 20 may be arranged in series to form a string 20B, while the second green LEDs 16D may be arranged in series to form a separate string 20D. The red LEDs 16C may be arranged in series to form a string 20C. Each string 20A-20D may be connected to an anode contact 22A-22D arranged at a first end of the tile 10 and a cathode contact 24A-24D arranged at the second end of the tile 10, respectively.

A string 20A-20D may include all, or less than all, of the corresponding LEDs in the first path 20 or the second path 21. For example, the string 20A may include all of the blue LEDs from all of the lighting elements 12 in the first path 20. Alternatively, a string 20A may include only a subset of the corresponding LEDs in the first path 20. Accordingly the first path 20 may include four serial strings 20A-20D arranged in parallel on the tile 10.

The second path 21 on the tile 10 may include four serial strings 21A, 21B, 21C, 21D arranged in parallel. The strings 21A to 21D are connected to anode contacts 26A to 26D, which are arranged at the second end of the tile 10 and to cathode contacts 28A to 28D, which are arranged at the first end of the tile 10, respectively.

It will be appreciated that, while the embodiments illustrated in FIGS. 1-3 include four LED chips 16 per lighting device 12 which are electrically connected to form at least four strings of LEDs 16 per path 20, 21, more and/or fewer than four LED chips 16 may be provided per lighting device 12, and more and/or fewer than four LED strings may be provided per path 20, 21 on the tile 10. For example, a lighting device 12 may include only one green LED chip 16B, in which case the LEDs may be connected to form three strings per path 20, 21. Likewise, in some embodiments, the two green LED chips in a lighting device 12 may be connected in serial to one another, in which case there may only be a single string of green LED chips per path 20, 22. Further, a tile 10 may include only a single path 20 instead of plural paths 20, 21 and/or more than two paths 20, 21 may be provided on a single tile 10.

Figure 4A:
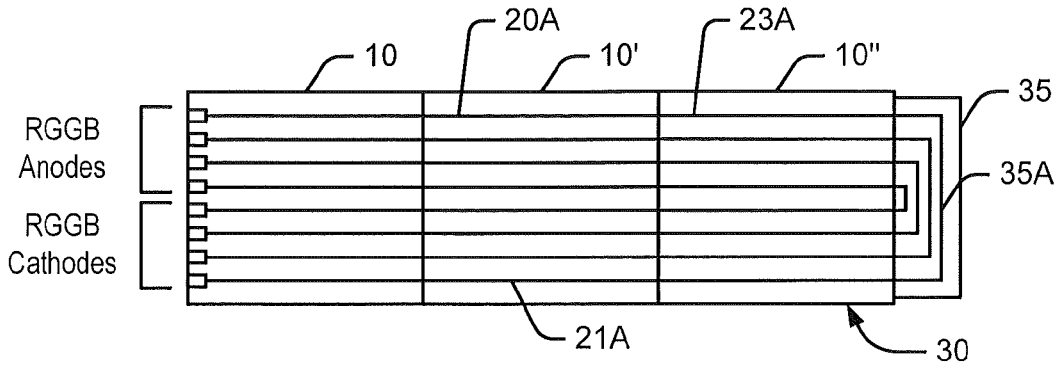
FIG. 4A is a front view of a bar assembly including multiple solid state lighting tiles in accordance with some embodiments of the invention.

Multiple tiles 10 may be assembled to form a larger lighting bar assembly 30 as illustrated in FIG. 4A. As shown therein, a bar assembly 30 may include two or more tiles 10, 10', 10" connected end-to-end. Accordingly, referring to FIGS. 3 and 4, the cathode contacts 24 of the first path 20 of the leftmost tile 10 may be electrically connected to the anode contacts 22 of the first path 20 of the central tile 10', and the cathode contacts 24 of the first path 20 of the central tile 10' may be electrically connected to the anode contacts 22 of the first path 20 of the rightmost tile 10", respectively. Similarly, the anode contacts 26 of the second path 21 of the leftmost tile 10 may be electrically connected to the cathode contacts 28 of the second path 21 of the central tile 10', and the anode contacts 26 of the second path 21 of the central tile 10' may be electrically connected to the cathode contacts 28 of the second path 21 of the rightmost tile 10", respectively.

Furthermore, the cathode contacts 24 of the first path 20 of the rightmost tile 10" may be electrically connected to the anode contacts 26 of the second path 21 of the rightmost tile 10" by a loopback connector 35. For example, the loopback connector 35 may electrically connect the cathode 24A of the string 20A of blue LED chips 16A of the first path 20 of the rightmost tile 10" with the anode 26A of the string 21A of blue LED chips of the second path 21 of the rightmost tile 10". In this manner, the string 20A of the first path 20 may be connected in serial with the string 21A of the second path 21 by a conductor 35A of the loopback connector 35 to form a single string 23A of blue LED chips 16. The other strings of the paths 20, 21 of the tiles 10, 10', 10" may be connected in a similar manner.

The loopback connector 35 may include an edge connector, a flexible wiring board, or any other suitable connector. In addition, the loop connector may include printed traces formed on/in the tile 10.

While the bar assembly 30 shown in FIG. 4A is a one dimensional array of tiles 10, other configurations are possible. For example, the tiles 10 could be connected in a two-dimensional array in which the tiles 10 are all located in the same plane, or in a three dimensional configuration in which the tiles 10 are not all arranged in the same plane. Furthermore the tiles 10 need not be rectangular or square, but could, for example, be hexagonal, triangular, or the like.

Figure 4B:
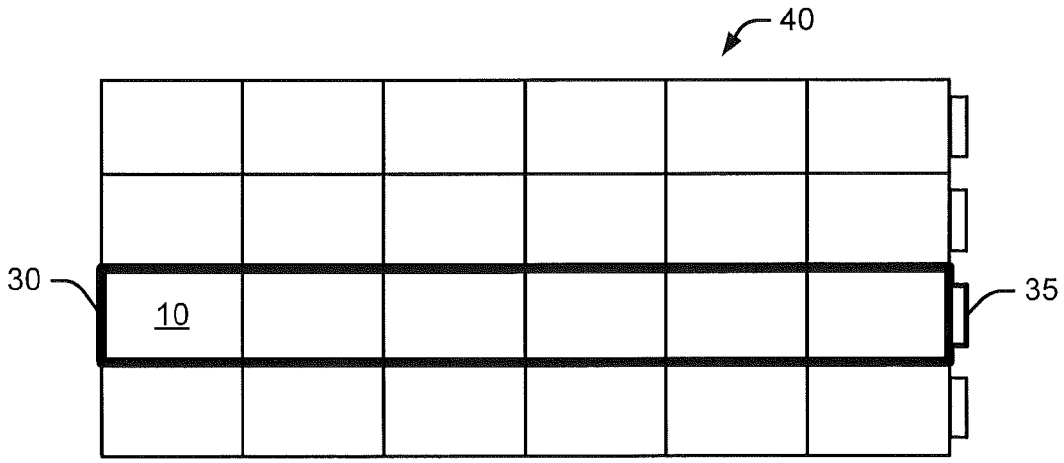
FIG. 4B is a front view of a lighting panel in accordance with some embodiments of the invention including multiple bar assemblies.

Referring to FIG. 4B, in some embodiments, a plurality of bar assemblies 30 may be combined to form a lighting panel 40, which may be used, for example, as a backlighting unit (BLU) for an LCD display. As shown in FIG. 4B, a lighting panel 40 may include four bar assemblies 30, each of which includes six tiles 10. The rightmost tile 10 of each bar assembly 30 includes a loopback connector 35. Accordingly, each bar assembly 30 may include four strings 23 of LEDs (i.e. one red, two green and one blue). Alternatively, each bar assembly 30 may include three strings 23 of LEDs (i.e. one red, one green and one blue).

In embodiments including four LED strings 23 (one red, two green and one blue) per bar assembly 30, a lighting panel 40 including nine bar assemblies may have 36 separate strings of LEDs. In embodiments including three LED strings 23 (one red, one green and one blue) per bar assembly 30, a lighting panel 40 including nine bar assemblies may have 27 separate strings of LEDs. Moreover, in a bar assembly 30 including six tiles 10 with eight solid state lighting elements 12 each, an LED string 23 may include 48 LEDs connected in serial.

For some types of LEDs, in particular blue and/or green LEDs, the forward voltage (Vf) may vary by as much as +/−0.75V from a nominal value from chip to chip at a standard drive current of 20 mA. A typical blue or green LED may have a Vf of 3.2 Volts. Thus, the forward voltage of such chips may vary by as much as 25%. For a string of LEDs containing 48 LEDs, the total Vf required to operate the string at 20 mA may vary by as much as +/−36V.

Accordingly, depending on the particular characteristics of the LEDs in a bar assembly, a string of one light bar assembly (e.g. the blue string) may require significantly different operating voltage compared to a corresponding string of another bar assembly. If the power supply is not designed accordingly, these variations may significantly affect the color and/or brightness uniformity of a lighting panel that includes multiple tiles 10 and/or bar assemblies 30, as such Vf variations may lead to variations in brightness and/or hue from tile to tile and/or from bar to bar. For example, current differences from string to string, which may result from large LED string voltage variations, may lead to large differences in the flux, peak wavelength, and/or dominant wavelength output by a string. Variations in LED drive current on the order of 5% or more may result in unacceptable variations in light output from string to string and/or from tile to tile. Such variations may significantly affect the overall color gamut, or range of displayable colors, of a lighting panel and/or may affect the uniformity of color and/or luminance, of a lighting panel.

In addition, the light output characteristics of LED chips may change during their operational lifetime. For example, the light output by an LED may change over time and/or with ambient temperature.

In order to provide consistent, controllable light output characteristics for a lighting panel, some embodiments of the invention provide a lighting panel having two or more serial strings of LED chips. An independent current control circuit is provided for each of the strings of LED chips. Furthermore, current to each of the strings may be individually controlled, for example, by means of pulse width modulation (PWM) and/or pulse frequency modulation (PFM). The width of pulses applied to a particular string in a PWM scheme (or the frequency of pulses in a PFM scheme) may be based on a pre-stored pulse width (frequency) value that may be modified during operation based, for example, on a user input and/or a sensor input.

Figure 5:
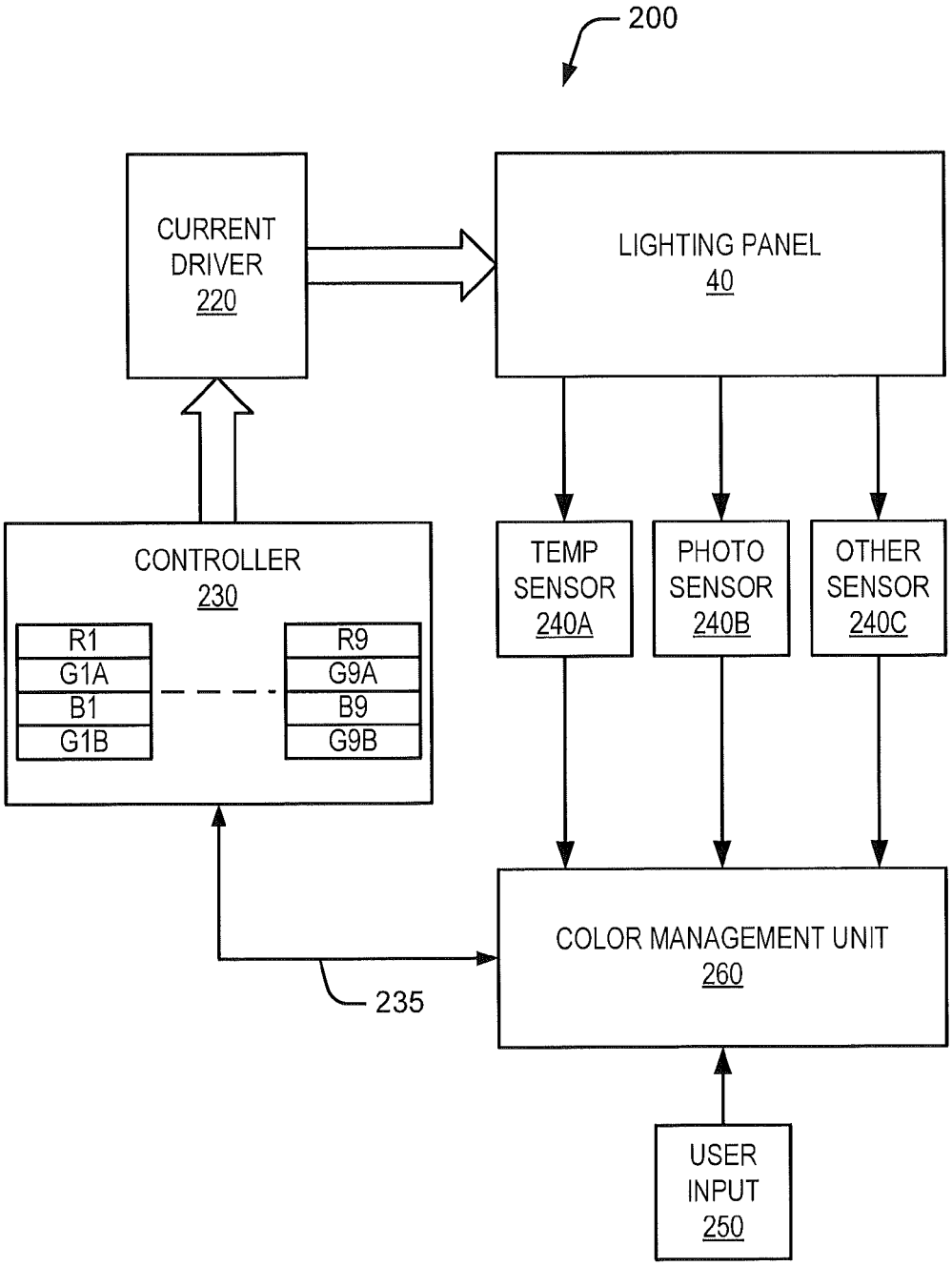
FIG. 5 is a schematic block diagram illustrating a lighting system in accordance with some embodiments of the invention.

Accordingly, referring to FIG. 5, a lighting system 200 is shown. The lighting system 200, which may be a backlight for an LCD display panel, includes a lighting panel 40. The lighting panel 40 may include, for example, a plurality of bar assemblies 30, which, as described above, may include a plurality of tiles 10. However, it will be appreciated that embodiments of the invention may be employed in conjunction with lighting panels formed in other configurations. For example, some embodiments of the invention may be employed with solid state backlight panels that include a single, large area tile.

In particular embodiments, however, a lighting panel 40 may include a plurality of bar assemblies 30, each of which may have four cathode connectors and four anode connectors corresponding to the anodes and cathodes of four independent strings 23 of LEDs each having the same dominant wavelength. For example, each bar assembly 23 may have a red string 23A, two green strings 23B, 23D, and a blue string 23C, each with a corresponding pair of anode/cathode contacts on one side of the bar assembly 30. In particular embodiments, a lighting panel 40 may include nine bar assemblies 30. Thus, a lighting panel 40 may include 36 separate LED strings (or 27 strings if only one green string is included per bar assembly).

A current driver 220 provides independent current control for each of the LED strings 23 of the lighting panel 40. For example, the current driver 220 may provide independent current control for 36 (or 27) separate LED strings in the lighting panel 40. The current driver 220 may provide a constant current source for each of the 36 (or 27) separate LED strings of the lighting panel 40 under the control of a controller 230. In some embodiments, the controller 230 may be implemented using an 8-bit microcontroller such as a PIC18F8722 from Microchip Technology Inc., which may be programmed to provide pulse width modulation (PWM) control of 36 separate current supply blocks within the driver 220 for the 36 (or 27) LED strings 23.

Pulse width information for each of the 36 (or 27) LED strings may be obtained by the controller 230 from a color management unit 260, which may in some embodiments include a color management controller such as the Avago HDJD-J822-SCR00 color management controller.

The color management unit 260 may be connected to the controller 230 through an I2C (Inter-Integrated Circuit) communication link 235. The color management unit 260 may be configured as a slave device on an I2C communication link 235, while the controller 230 may be configured as a master device on the link 235. I2C communication links provide a low-speed signaling protocol for communication between integrated circuit devices. The controller 230, the color management unit 260 and the communication link 235 may together form a feedback control system configured to control the light output from the lighting panel 40. The registers R1-R9, etc., may correspond to internal registers in the controller 230 and/or may correspond to memory locations in a memory device (not shown) accessible by the controller 230.

The controller 230 may include a register, e.g. registers R1-R9, G1A-G9A, B1-B9, G1B-G9B, for each LED string 23, i.e. for a lighting unit with 36 LED strings 23, the color management unit 260 may include at least 36 registers. Each of the registers is configured to store pulse width information for one of the LED strings 23. The initial values in the registers may be determined by an initialization/calibration process. However, the register values may be adaptively changed over time based on user input 250 and/or input from one or more sensors 240 coupled to the lighting panel 40.

The sensors 240 may include, for example, a temperature sensor 240A, one or more photosensors 240B, and/or one or more other sensors 240C. In particular embodiments, a lighting panel 40 may include one photosensor 240B for each bar assembly 30 in the lighting panel. However, in other embodiments, one photosensor 240B could be provided for each LED string 30 in the lighting panel. In other embodiments, each tile 10 in the lighting panel 40 may include one or more photosensors 240B.

In some embodiments, the photosensor 240B may include photo-sensitive regions that are configured to be preferentially responsive to light having different dominant wavelengths. Thus, wavelengths of light generated by different LED strings 23, for example a red LED string 23A and a blue LED string 23C, may generate separate outputs from the photosensor 240B. In some embodiments, the photosensor 240B may be configured to independently sense light having dominant wavelengths in the red, green and blue portions of the visible spectrum. The photosensor 240B may include one or more photosensitive devices, such as photodiodes. The photosensor 240B may include, for example, an Avago HDJD-S831-QT333 tricolor photo sensor.

Sensor outputs from the photosensors 240B may be provided to the color management unit 260, which may be configured to sample such outputs and to provide the sampled values to the controller 230 in order to adjust the register values for corresponding LED strings 23 in order to correct variations in light output on a string-by-string basis. In some embodiments, an application specific integrated circuit (ASIC) may be provided on each tile 10 along with one or more photosensors 240B in order to pre-process sensor data before it is provided to the color management unit 260. Furthermore, in some embodiments, the sensor output and/or ASIC output may be sampled directly by the controller 230.

The photosensors 240B may be arranged at various locations within the lighting panel 40 in order to obtain representative sample data. Alternatively and/or additionally, light guides such as optical fibers may be provided in the lighting panel 40 to collect light from desired locations. In that case, the photosensors 240B need not be arranged within an optical display region of the lighting panel 40, but could be provided, for example, on the back side of the lighting panel 40. Further, an optical switch may be provided to switch light from different light guides which collect light from different areas of the lighting panel 40 to a photosensor 240B. Thus, a single photosensor 240B may be used to sequentially collect light from various locations on the lighting panel 40.

The user input 250 may be configured to permit a user to selectively adjust attributes of the lighting panel 40, such as color temperature, brightness, hue, etc., by means of user controls such as manual input controls on an LCD panel and/or software-based input controls if, for example, the LCD panel is a computer monitor.

The temperature sensor 240A may provide temperature information to the color management unit 260 and/or the controller 230, which may adjust the light output from the lighting panel on a string-to-string and/or color-to-color basis based on known/predicted brightness vs. temperature operating characteristics of the LED chips 16 in the strings 23.

Various configurations of photosensors 240B are shown in FIGS. 6A-6D. For example, in the embodiments of FIG. 6A, a single photosensor 240B is provided in the lighting panel 40. The photosensor 240B may be provided at a location where it may receive an average amount of light from more than one tile/string in the lighting panel.

Figure 6A:
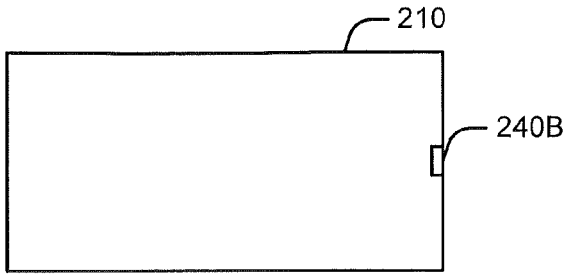
FIGS. 6A-6D are a schematic diagrams illustrating possible configurations of photosensors on a lighting panel in accordance with some embodiments of the invention.
Figure 6B:
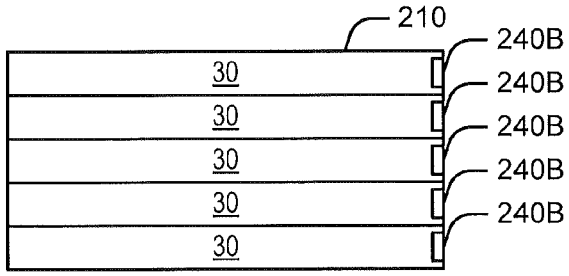

In order to provide more extensive data regarding light output characteristics of the lighting panel 40, more than one photosensor 240B may be used. For example, as shown in FIG. 6B, there may be one photosensor 240B per bar assembly 30. In that case, the photosensors 240B may be located at ends of the bar assemblies 30 and may be arranged to receive an average/combined amount of light emitted from the bar assembly 30 with which they are associated.

Figure 6C:
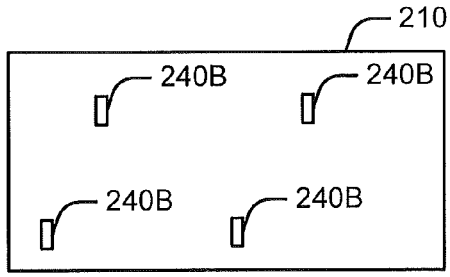

As shown in FIG. 6C, photosensors 240B may be arranged at one or more locations within a periphery of the light emitting region of the lighting panel 40. However in some embodiments, the photosensors 240B may be located away from the light emitting region of the lighting panel 40, and light from various locations within the light emitting region of the lighting panel 40 may be transmitted to the sensors 240B through one or more light guides. For example, as shown in FIG. 6D, light from one or more locations 249 within the light emitting region of the lighting panel 40 is transmitted away from the light emitting region via light guides 247, which may be optical fibers that may extend through and/or across the tiles 10.

Figure 6D:
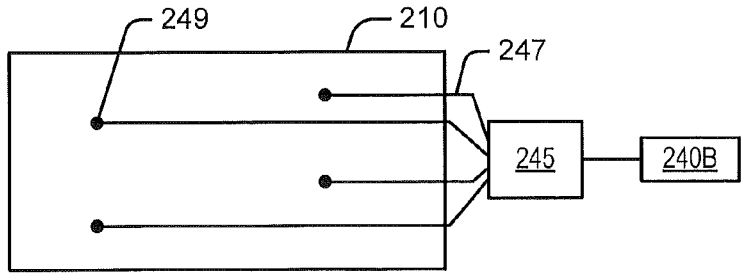

In the embodiments illustrated in FIG. 6D, the light guides 247 terminate at an optical switch 245, which selects a particular guide 247 to connect to the photosensor 240B based on control signals from the controller 230 and/or from the color management unit 260. It will be appreciated, however, that the optical switch 245 is optional, and that each of the light guides 245 may terminate at a respective photosensor 240B. In further embodiments, instead of an optical switch 245, the light guides 247 may terminate at a light combiner, which combines the light received over the light guides 247 and provides the combined light to a photosensor 240B. The light guides 247 may extend across partially across, and/or through the tiles 10. For example, in some embodiments, the light guides 247 may run behind the panel 40 to various light collection locations and then run through the panel at such locations. Furthermore, the photosensor 240B may be mounted on a front side of the panel (i.e. on the side of the panel 40 on which the lighting devices 16 are mounted) or on a reverse side of the panel 40 and/or a tile 10 and/or bar assembly 30.

Figure 7:
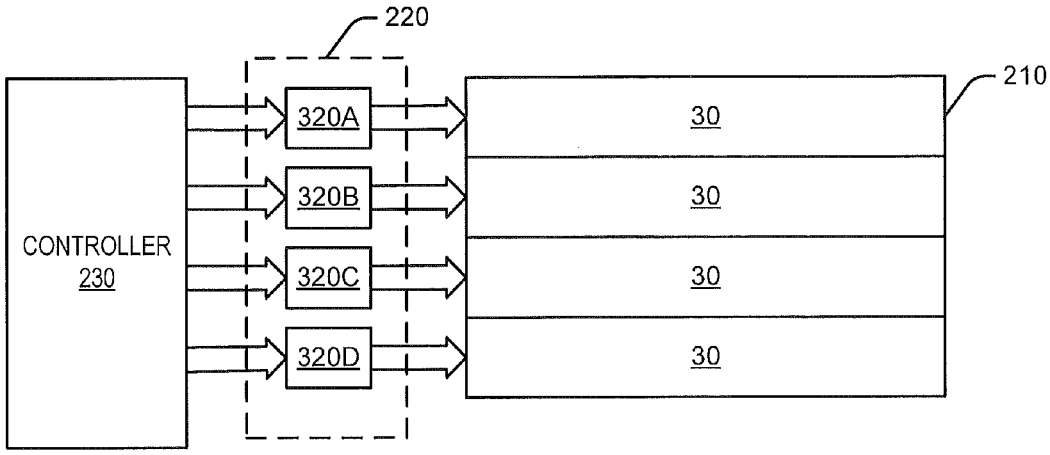
FIGS. 7-8 are schematic diagrams illustrating elements of a lighting system according to some embodiments of the invention.
Figure 8:
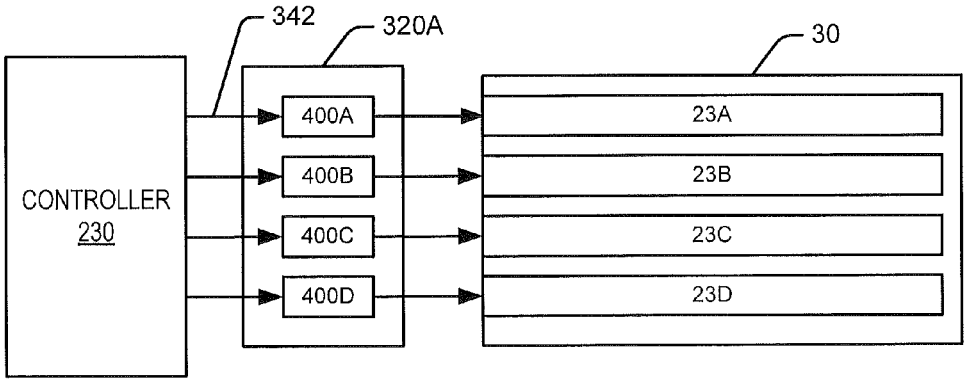

Referring now to FIG. 7, a current driver 220 may include a plurality of bar driver circuits 320A-320D. One bar driver circuit 320A-320D may be provided for each bar assembly 30 in a lighting panel 40. In the embodiments shown in FIG. 7, the lighting panel 40 includes four bar assemblies 30. However, in some embodiments the lighting panel 40 may include nine bar assemblies 30, in which case the current driver 220 may include nine bar driver circuits 320. As shown in FIG. 8, in some embodiments, each bar driver circuit 320 may include four current supply circuits 400A-400D, i.e., one current supply circuit 400A-400D for each LED string 23A-23D of the corresponding bar assembly 30. Operation of the current supply circuits 400A-400B may be controlled by control signals 342 from the controller 230.

Figure 9:
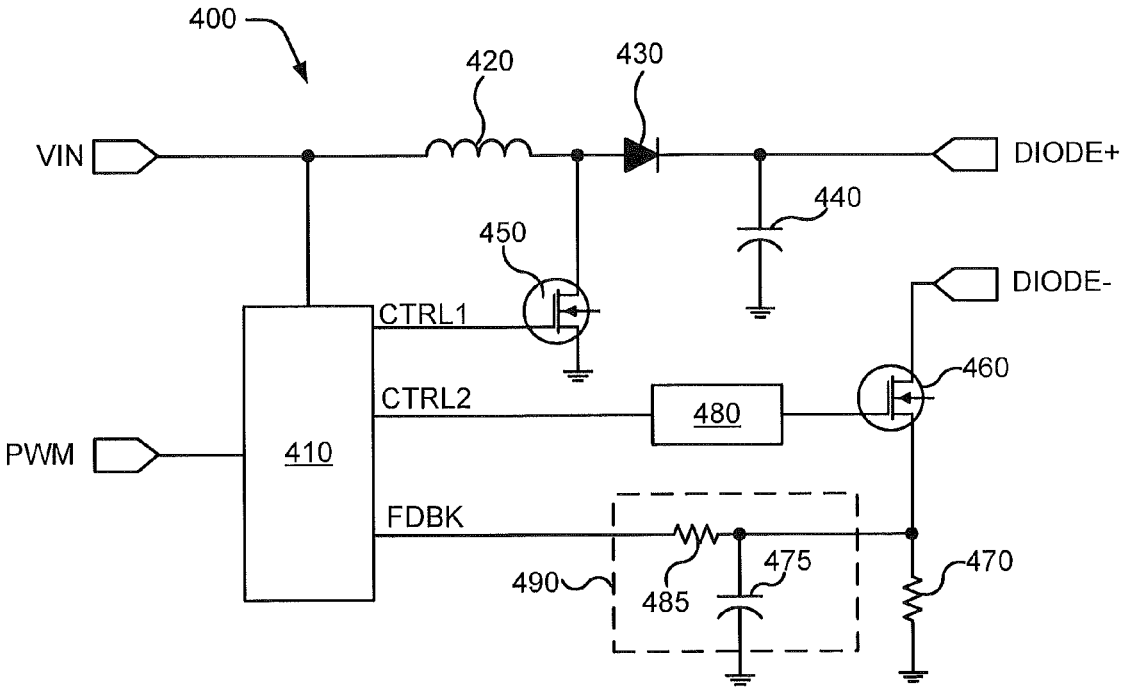
FIG. 9 is a schematic circuit diagram of a current supply circuit according to some embodiments of the invention.

A current supply circuit 400 according to some embodiments of the invention is illustrated in more detail in FIG. 9. As shown therein, a current supply circuit 400 may have a variable voltage boost converter configuration including a PWM controller 410, a charging inductor 420, a diode 430, an output capacitor 440, first and second control transistors 450, 460, and a sense resistor 470. The current supply circuit 400 receives an input voltage VIN, which may be 34V in some embodiments. The current supply circuit 400 also receives a pulse width modulation signal PWM from the controller 230. The current supply circuit 400 is configured to provide a substantially constant current to a corresponding LED string 23 via output terminals DIODE+ and DIODE−, which are connected to the anode and cathode of the corresponding LED string, respectively. The current supply circuit may act as a voltage boost converter to provide the high voltage that may be required to drive an LED string 23. For example, an LED string 23 may require a forward voltage of about 170 V or more. Furthermore, the constant current may be supplied with a variable voltage boost to account for differences in average forward voltage from string to string. The PWM controller 410 may include, for example, an HV9911NG current mode PWM controller from Supertex.

The current supply circuit 400 is configured to supply current to the corresponding LED string 23 while the PWM input is a logic HIGH. Accordingly, for each timing loop, the PWM input of each current supply circuit 400 in the driver 220 is set to logic HIGH at the first clock cycle of the timing loop. The PWM input of a particular current supply circuit 400 is set to logic LOW, thereby turning off current to the corresponding LED string 23, when a counter in the controller 230 reaches the value stored in a register of the controller 230 corresponding to the LED string 23. Thus, while each LED string 23 in the lighting panel 40 may be turned on simultaneously, the strings may be turned off at different times during a given timing loop, which would give the LED strings different pulse widths within the timing loop. The apparent brightness of an LED string 23 may be approximately proportional to the duty cycle of the LED string 23, i.e., the fraction of the timing loop in which the LED string 23 is being supplied with current.

An LED string 23 may be supplied with a substantially constant current during the period in which it is turned on. By manipulating the pulse width of the current signal, the average current passing through the LED string 23 may be altered even while maintaining the on-state current at a substantially constant value. Thus, the dominant wavelength of the LEDs 16 in the LED string 23, which may vary with applied current, may remain substantially stable even though the average current passing through the LEDs 16 is being altered. Similarly, the luminous flux per unit power dissipated by the LED string 23 may remain more constant at various average current levels than, for example, if the average current of the LED string 23 was being manipulated using a variable current source.

The value stored in a register of the controller 230 corresponding to a particular LED string may be based on a value received from the color management unit 260 over the communication link 235. Alternatively and/or additionally, the register value may be based on a value and/or voltage level directly sampled by the controller 230 from a sensor 240.

In some embodiments, the color management unit 260 may provide a value corresponding to a duty cycle (i.e. a value from 0 to 100), which may be translated by the controller 230 into a register value based on the number of cycles in a timing loop. For example, the color management unit 260 indicates to the controller 230 via the communication link 235 that a particular LED string 23 should have a duty cycle of 50%. If a timing loop includes 10,000 clock cycles, then assuming the controller increments the counter with each clock cycle, the controller 230 may store a value of 5000 in the register corresponding to the LED string in question. Thus, in a particular timing loop, the counter is reset to zero at the beginning of the loop and the LED string 23 is turned on by sending an appropriate PWM signal to the current supply circuit 400 serving the LED string 23. When the counter has counted to a value of 5000, the PWM signal for the current supply circuit 400 is reset, turning the LED string off.

In some embodiments, the pulse repetition frequency (i.e. pulse repetition rate) of the PWM signal may be in excess of 60 Hz. In particular embodiments, the PWM period may be 5 ms or less, for an overall PWM pulse repetition frequency of 200 Hz or greater. A delay may be included in the loop, such that the counter may be incremented only 100 times in a single timing loop. Thus, the register value for a given LED string 23 may correspond directly to the duty cycle for the LED string 23. However, any suitable counting process may be used provided that the brightness of the LED string 23 is appropriately controlled.

The register values of the controller 230 may be updated from time to time to take into account changing sensor values. In some embodiments, updated register values may be obtained from the color management unit 260 multiple times per second.

Furthermore, the data read from the color management unit 260 by the controller 230 may be filtered to limit the amount of change that occurs in a given cycle. For example, when a changed value is read from the color management unit 260, an error value may be calculated and scaled to provide proportional control ("P"), as in a conventional PID (Proportional-Integral-Derivative) feedback controller. Further, the error signal may be scaled in an integral and/or derivative manner as in a PID feedback loop. Filtering and/or scaling of the changed values may be performed in the color management unit 260 and/or in the controller 230.

The configuration and operation of a variable voltage boost current supply circuit 400 according to some embodiments of the invention will now be described in greater detail. As noted above, a current supply circuit 400 may include a PWM controller 410 that is configured to control the operation of a first transistor 450 and a second transistor 460 to provide a constant current to the output terminals DIODE+ and DIODE−. When the first transistor 450 is turned on by the control signal CTRL1 from the PWM controller 410, the charging inductor 420 is energized by the input voltage VIN. In some embodiments, the input voltage VIN may be about 34 VDC (compared to 24 VDC for a typical voltage converter operating in discontinuous conduction mode, as explained in more detail below).

When the first transistor 450 is turned off, magnetic energy stored in the charging inductor 420 is discharged as a current through the rectifier diode 430 and is stored in the output capacitor 440. By repeatedly charging and discharging the magnetic field of the charging inductor 420, a high voltage can be built up in the output capacitor 440. When the second transistor 460 is activated by the control signal CTRL2 from the PWM controller 410, the voltage stored in the output capacitor 440 is applied to the output terminal DIODE+. The control signal CTRL2 may be filtered by a low pass filter 480 to remove sharp edges from the control signal CTRL2 that may cause ringing or oscillation of the transistor 460.

The current through the output terminals is monitored by the PWM controller 410 as a feedback signal FDBK which corresponds to a voltage on the sense resistor 470. The feedback signal FDBK may be filtered by a low pass filter 490, which may be, for example an RC filter including a series resistor 485 and a shunt capacitor 475, in order to suppress transient currents that may arise when the LED string 23 is turned on.

The voltage stored on the output capacitor 440 is adjusted by the PWM controller 410 in response to the feedback signal FDBK to provide a constant current through the output terminals.

A conventional current driver may operate in discontinuous conduction mode (DCM), in which current does not flow continuously through the charging inductor 420. In some embodiments of the present invention, the current supply circuits 400 in the driver circuits 320 are configured to operate in continuous conduction mode (CCM), in which current flows continuously through the charging inductor 420.

Figure 10:
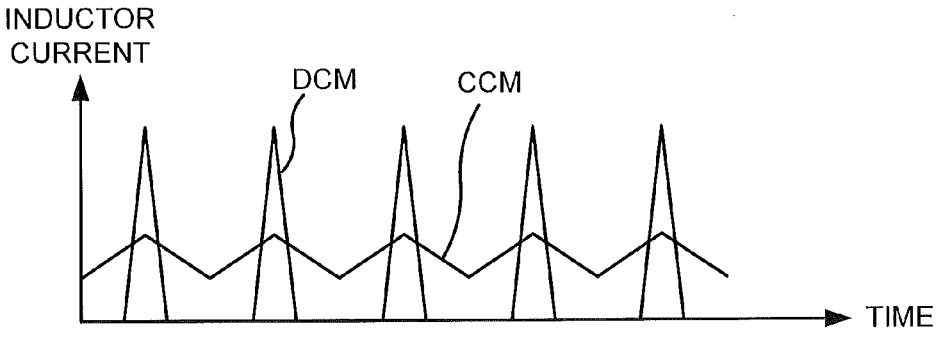
FIG. 10 is a graph of inductor current versus time for a current supply circuit according to some embodiments of the invention.

Representative inductor current waveforms for continuous conduction mode and discontinuous conduction mode are shown in FIG. 10. The waveforms shown in FIG. 10 are illustrative only and do not represent actual or simulated waveforms. In particular, the inductor current of a current supply circuit operating in discontinuous conduction mode (DCM) has a series of peaks followed by periods of zero current. In the continuous conduction mode (CCM), the inductor current has peaks. However, the peak currents may be lower than in DCM, and the inductor current may not return to zero between the peaks.

Since the power dissipated by the current supply circuit 400 is dependent on the square of the inductor current ($P=I^2R$), DCM operation may consume more electric power than CCM operation, even though there are periods of no current conduction between the peaks of the DCM output current, because the peaks of the DCM output current may result in significant average power dissipation.

A circuit configured for CCM operation may have a similar topology as a circuit configured for DCM operation. However, in a circuit configured for CCM operation according to some embodiments of the invention, the charging inductor 420 may have a larger inductance value than an inductor used for DCM operation. For example, in a current supply circuit 400 configured according to some embodiments of the invention, the charging inductor 420 may have an inductance of about 50 μH to about 1.3 mH. In particular embodiments, the charging inductor 420 may have an inductance of about 680 μH.

The value of the charging inductor 420 that results in CCM operation may depend on a number of factors, including the type of PWM controller IC used, the boost ratio (i.e. the ratio of output voltage to input voltage), and/or the number of LEDs in the string being driven. In some cases, if the boost ratio is too high, an inductance that would otherwise result in CCM operation may instead result in DCM operation.

In some embodiments according to the invention, a current supply circuit 400 operating in CCM may achieve greater than 85% conversion efficiency, and in some cases may achieve greater than 90% conversion efficiency, compared to a typical DCM converter, which may be capable of only about 80% conversion efficiency (defined as power out/power in ×100). The difference between 80% efficiency and 90% efficiency may represent a reduction in the amount of energy wasted (and hence heat produced) of 50% (i.e., 20% to 10%). A fifty percent reduction in heat dissipation may allow the lighting panel to run cooler and/or for the LEDs thereon to operate more efficiently, and/or may enable the production of lighting panel systems having smaller heat sinks and/or that require less cooling. Accordingly, a lighting system including a current supply circuit 400 according to embodiments of the invention may be made smaller, thinner, lighter, and/or less expensively.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A lighting system, comprising:

at least two strings of solid state lighting devices that are respectively configured to emit at least a first light and a second light, respectively;

at least two current supply circuits coupled to first and second strings of the at least two strings, respectively, each of the current supply circuits configured to supply an on-state drive current to a respective string of the at least two strings of solid state lighting devices in response to at least one control signal generated in response to a sensor output signal generated by at least one temperature sensor, each of the current supply circuits comprising:

a controller having a control input, a first control output configured to provide a first PWM control signal, and a second control output configured to provide a second PWM control signal; and first and second output terminals coupled to the respective string of the at least two strings of solid state lighting devices.

2. The lighting system according to claim 1, further comprising a sense resistor coupled to the second output terminal of ones of the current supply circuits.

3. The lighting system according to claim 2, wherein the controller further comprises a feedback input coupled to the sense resistor, and wherein the controller is configured to activate the second control signal in response to a feedback signal received on the feedback input.

4. The lighting system according to claim 1, wherein the controller comprises a closed loop control system that is configured to generate the first and second PWM control signals in response to the sensor output signals generated by the at least one temperature sensor.

5. The lighting system according to claim 1, wherein ones of the at least two current supply circuits comprise a variable voltage boost, constant current power supply circuit configured to operate in continuous current mode.

6. The lighting system according to claim 1, wherein ones of the at least two current supply circuits comprise a voltage input terminal, and a control input terminal.

7. The lighting system according to claim 1, wherein ones of the at least two current supply circuits comprise a charging inductor coupled to the voltage input terminal and an output capacitor coupled to the first output terminal.

8. The lighting system according to claim 7, wherein the ones of the at least two current supply circuits are each configured to operate in continuous conduction mode in which current continuously flows through the charging inductor while the on-state drive current is supplied to the first and second strings, respectively.

9. The lighting system according to claim 7, wherein each of the current supply circuits comprises:

a rectifier having an anode coupled to the charging inductor and a cathode coupled to the output capacitor; and a first control transistor coupled to the anode of the rectifier and having a control terminal coupled to the first control output of the controller, wherein the first control transistor is configured to cause the charging inductor to be energized in response to the first PWM control signal from the controller and to cause energy stored in the charging inductor to be discharged through the rectifier and into the output capacitor in response to the first PWM control signal.

10. The lighting system according to claim 9, further comprising a second control transistor coupled to the second output terminal of the current supply circuit and having an input coupled to the second control output of the controller;

wherein the second control transistor is configured to cause a voltage stored in the output capacitor to be applied to the first output terminal of the current supply circuit in response to the second PWM control signal from the controller.

11. The lighting system according to claim 10, wherein ones of the current supply circuits further comprise:

a low pass filter between the second control output and the second control transistor.

12. The lighting system according to claim 7, wherein the charging inductor has an inductance of about 50 μH to about 1.3 mH.

13. The lighting system according to claim 7, wherein the charging inductor has an inductance of about 680 pH.

14. The lighting system according to claim 1, wherein the sensor output signal comprises a first sensor output signal, further comprising a light sensor that generates a second sensor output signal responsive to light output by the lighting system, wherein the at least one control signal comprises the first sensor output signal and the second output sensor signal.

15. The lighting system according to claim 1, wherein ones of the current supply circuits are configured to convert at least about 85% of input power into output power.

16. The lighting system according to claim 1, wherein ones of the current supply circuits are configured to convert at least about 90% of input power into output power.

17. A lighting system, comprising:

a lighting panel including at least first and second strings of solid state lighting devices that are respectively configured to emit at least a first light and a second light, respectively;

at least first and second current supply circuits coupled to the at least first and second strings of solid state lighting devices, respectively, and configured to supply an on-state drive current to a respective one of the first and second strings of solid state lighting devices; and a pulse width modulation (PWM) controller that is coupled to the first current supply circuit and the second current supply circuit and that is configured to generate, for each of the first current supply circuit and the second current supply circuit, a first PWM control signal and a second PWM control signal that are supplied to the each of the at least first and second strings.

18. The lighting system according to claim 17, wherein each of the first and second current supply circuits comprises a variable voltage boost, constant current power supply circuit configured to operate in continuous current mode.

19. The lighting system according to claim 18, wherein each of the first and second current supply circuits comprises:

a temperature sensor that is configured to generate a sensor output signal that the PWM controller uses to generate the first PWM signal or the second PWM signal, and a sense resistor that is coupled to an output terminal of the current supply circuit and that is configured to provide a feedback signal to the PWM controller.

20. The lighting system according to claim 17, wherein each of the first and second current supply circuits comprises a sense resistor that is coupled to an output terminal of the respective one of the first and second current supply circuits and that is coupled to a feedback input to provide the feedback signal to provide closed loop control.

21. The lighting system according to claim 20, further comprising a filter coupled to the sense resistor, the filter configured to filter the feedback input.

22. The lighting system according to claim 17, wherein the first string of solid state lighting devices are coated with a wavelength conversion phosphor and are configured to emit the first light that includes a combined light including a dominant wavelength corresponding to a blue color and a dominant wavelength corresponding to a yellow color, and wherein the second string of solid state lighting devices are configured to emit the second light that includes a dominant wavelength corresponding to a red color.

23. The lighting system according to claim 22, wherein the first current supply circuit provides current control of the first string of solid state lighting devices that is independent of current control of the second string of solid state lighting devices provided by the second current supply circuit.

24. The lighting system according to claim 22, further comprising a third string of solid state lighting devices that are configured to emit a third light that includes a dominant wavelength corresponding to a red color.

25. The lighting system according to claim 24, further comprising a third current supply circuit that is configured to supply an on-state drive current to the third string of solid state lighting devices, and wherein the first current supply circuit provides current control of the first string of solid state lighting devices that is independent of current control of the second string of solid state lighting devices provided by the second current supply circuit and that is independent of current control of the third string of solid state lighting devices provided by the third current supply circuit.

* * * * *

UNITED STATES PATENT AND TRADEMARK OFFICE

CERTIFICATE OF CORRECTION

PATENT NO. : 8,941,331 B2
APPLICATION NO. : 13/896977
DATED : January 27, 2015
INVENTOR(S) : Roberts et al.

It is certified that error appears in the above-identified patent and that said Letters Patent is hereby corrected as shown below:

In the Claims:

Column 17, Claim 13, Line 2: Please correct "of about 680 pH."
to read -- of about 680 μH. --

Signed and Sealed this
Nineteenth Day of May, 2015

Michelle K. Lee

Michelle K. Lee
*Director of the United States Patent and Trademark Office*